US006650300B2

(12) United States Patent
Skalina et al.

(10) Patent No.: US 6,650,300 B2
(45) Date of Patent: Nov. 18, 2003

(54) COMMON APERTURE UHF/ HORIZONTALLY POLARIZED LOW-AND MID-BAND VHF ANTENNA

(75) Inventors: Andre Skalina, Portland, ME (US); John Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/015,777

(22) Filed: Dec. 17, 2001

(65) Prior Publication Data

US 2003/0112197 A1 Jun. 19, 2003

(51) Int. Cl.[7] ..... H01Q 9/04; H01Q 13/10
(52) U.S. Cl. ..... 343/791; 343/770; 343/790
(58) Field of Search ..... 343/790, 791, 343/792, 770, 890, 795, 799; H01Q 13/10, 9/04

(56) References Cited

U.S. PATENT DOCUMENTS

| | | | | | |
|---|---|---|---|---|---|
| 4,145,696 | A | * | 3/1979 | Gueguen | 343/792.5 |
| 4,290,069 | A | * | 9/1981 | Duda | 343/722 |
| 5,497,166 | A | * | 3/1996 | Mahnad | 343/795 |
| 6,181,292 | B1 | * | 1/2001 | Dobrovolny | 343/819 |
| 6,373,444 | B1 | * | 4/2002 | Schadler | 343/770 |
| 6,480,168 | B1 | * | 11/2002 | Lam et al. | 343/805 |

* cited by examiner

*Primary Examiner*—Hoanganh Le
(74) *Attorney, Agent, or Firm*—Baker & Hostetler

(57) ABSTRACT

A common aperture UHF/horizontally polarized low- and mid-band VHF antenna is disclosed that includes a coaxial antenna that has an inner conductor, an outer conductor, a batwing assembly mounted to the outer conductor of the coaxial antenna, and a feed line for feeding the batwing assembly separate from the coaxial antenna. The disclosed slotted coaxial antenna accomplishes simultaneous UHF and VHF broadcast.

19 Claims, 4 Drawing Sheets

COMMON APERTURE UHF/ HORIZONTALLY POLARIZED LOW-AND MID-BAND VHF ANTENNA

FIELD OF THE INVENTION

The present invention relates generally to the field of broadcast antenna designs. More particularly, the present invention relates to the design of a television broadcast antenna that would allow for simultaneous UHF and either low- or mid-band VHF broadcast with equal or less wind load than existing VHF only antennas.

BACKGROUND OF THE INVENTION

Under the rules of the Federal Communication Commission (FCC), by the year 2006 television broadcasters are required to transition from current National Television System Committee (NTSC) antenna systems to digital television (DTV) antenna systems. NTSC antenna systems are analog systems and during operation of analog NTSC systems only one television transmission signal is transmitted per channel. Typically NTSC television antennas transmit either one very high frequency (VHF) channel or one ultra high frequency (UHF) channel.

DTV is a new type of broadcasting technology. So far the FCC has allocated mostly UHF Channels for DTV broadcasts. DTV antenna systems transmit the information used to make television pictures and sounds by data bits, rather than by waveforms, as performed by NTSC systems. With DTV, broadcasters will be able to provide television programming of a higher resolution and better picture quality than what can be provided under the current analog NTSC antenna systems. In addition, DTV broadcasters will be able to transmit more than one signal per channel, and thus, deliver more than one television program per station.

The majority of antennas used for UHF transmission in NTSC systems are slotted coaxial designs. UHF slotted coaxial antennas gained widespread use in NTSC broadcasting because of their above-average performance characteristics, namely excellent omni-directional azimuth patterns, low wind loads, and smooth null fill.

While the foregoing performance characteristics are also desirable for DTV transmission, the more stringent antenna output performance standards of DTV transmission cannot be met with current slotted coaxial antenna designs. At the present stage of antenna development, the antenna output response performance across multiple channels, which was given little consideration in NTSC systems, is now an important parameter for DTV transmission.

For example, when used as television broadcasting antennas, slotted coaxial antennas are generally optimized to transmit signals for a specified television channel having a six MHz bandwidth. For NTSC transmission, the power distribution across the six MHz bandwidth is concentrated at three basic carrier frequencies, namely, picture, color and aural. Therefore, the performance of the antenna is critical only at these three carrier frequencies.

However, for DTV transmission, the power is equally distributed across a 5.4 MHz frequency span within the six MHz bandwidth. Therefore, the antenna's performance is critical across substantially the entire operating band. This means that the antenna's elevation pattern must remain stable (i.e. unchanged) at all frequencies within the bandwidth, and not just at isolated frequencies.

Use of existing UHF slotted coaxial antennas for DTV transmission is therefore hindered by the fact that slotted coaxial antennas are not suitable for multi-channel applications, such as simultaneous UHF and VHF signaling. This is due in part to the fact that the slots are not broadband radiators.

All current analog TV broadcasts, including all current VHF broadcasts, will be phased out by the end of 2006. During the transition to DTV, broadcasters will be operating both analog (NTSC) and digital (DTV) channels.

This presents a problem, especially to VHF broadcasters that have been assigned UHF/DTV channels, because VHF television broadcasters are faced with having to transmit television programming on two antenna systems, the conventional analog VHF/NTSC antenna system and the DTV antenna system. This is a problem for broadcasters because many towers are not strong enough to accept the additional windload of a second antenna.

Accordingly, it is desirable to provide a UHF slotted coaxial antenna that transmits DTV signals with excellent omni-directional azimuth patterns, low wind loads, and smooth null fill. It is also desirable to provide a replacement antenna that would allow for simultaneous UHF and either low or mid-band VHF broadcast with equal or less wind load than existing VHF only antennas, and thus reduce the wind load on the antenna tower structure.

SUMMARY OF THE INVENTION

In one aspect of the present invention an antenna is provided that includes a coaxial antenna having an inner conductor and an outer conductor, a batwing assembly mounted to the outer conductor of the coaxial antenna, and a feed line for feeding the batwing assembly separately from the coaxial antenna.

In another aspect of the present invention the batwing assembly includes four planar wings.

In another aspect of the present invention, the planar wings are spaced concentrically around the outer conductor.

In another respect of the present invention, the coaxial antenna transmits a UHF signal and the batwing assembly transmits a VHF signal.

In another aspect of the present invention, the inner conductor includes a transmission line inner conductor and a transmission line outer conductor.

In another aspect of the present invention, the transmission line inner conductor is made from copper.

In another aspect of the present invention, the outer conductor is made from steel.

In another aspect of the present invention, the inner conductor is connected to a center feed.

In another aspect of the present invention, the center feed is substantially intermediate a top spoke short and a bottom spoke short.

In another aspect of the present invention, an antenna is provided that includes a means for transmitting a UHF signal, a means mounted to the UHF antenna means for transmitting VHF signal, and a feed means for feeding the UHF signal transmitting means separate from the VHF signal transmitting means.

In another aspect of the present invention, a method of constructing a UHF and VHF broadcast antenna is provided that includes forming a coaxial antenna having an inner conductor and an outer conductor, mounting a batwing assembly to the outer conductor of the coaxial antenna, and connecting a feed line to the batwing assembly.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
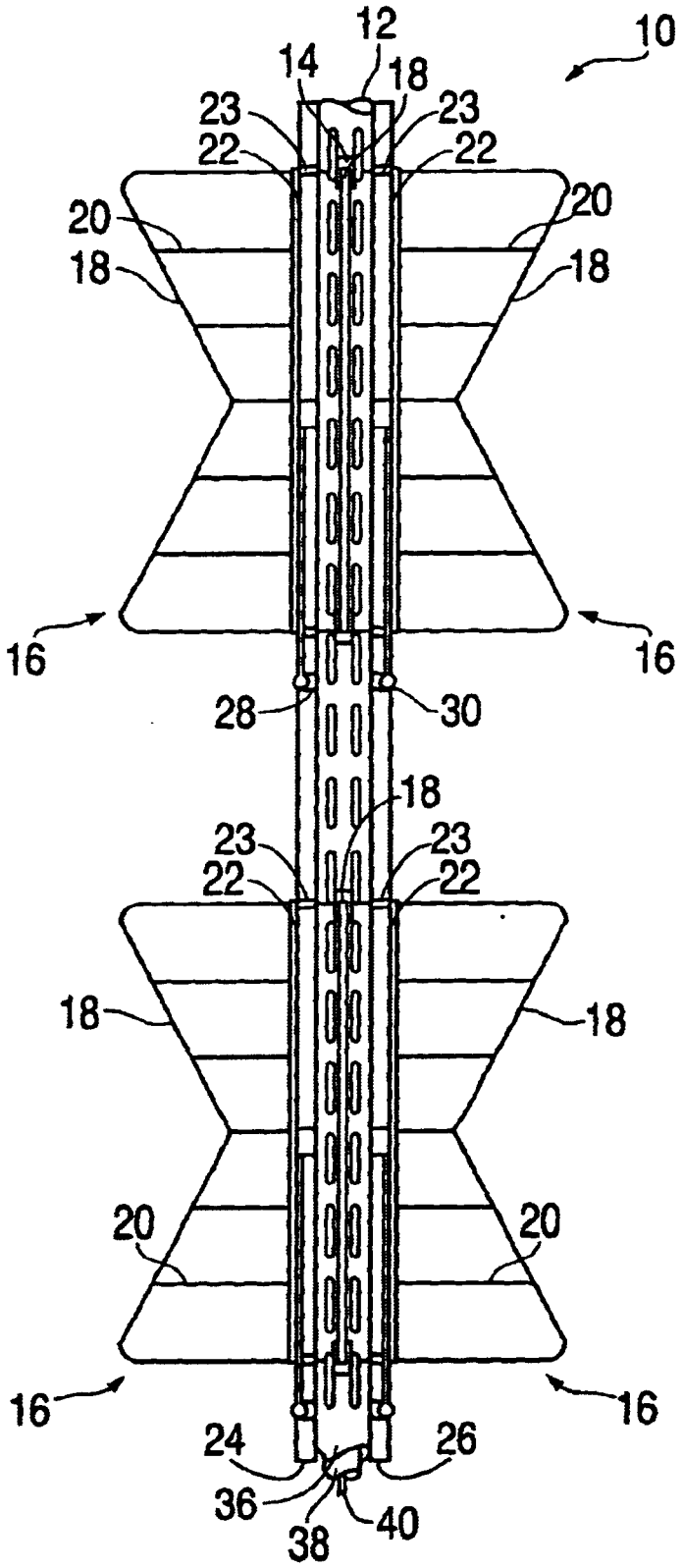
FIG. 1 is a side plan view of a common aperture UHF/horizontally polarized low- and mid-band VHF antenna in accordance with a preferred embodiment of the present invention.

Referring now to the figures wherein like reference numerals indicate like elements, in FIG. 1 there is shown an embodiment of a horizontally polarized low- and mid-band VHF/UHF common aperture antenna 10. The common aperture antenna 10 includes an elongated, cylindrical hollow mast 12. The mast 12 acts as a UHF antenna outer conductor and is preferably constructed seamlessly from a suitable material, such as steel or aluminum.

Longitudinally spaced slots 14 are formed in the mast 12. The slots of the antenna 10 are located in such a way as to minimize the effect of the superturnstyle/batwing radiator assemblies 16 on the radiation patterns of the UHF signal and the impedance of the UHF signal.

The radiator assemblies 16 are located on the outside of the mast 12 for broadcasting VHF signals. In the exemplary embodiment of the present invention shown in FIG. 1, two layers of radiator assemblies 16 are depicted with one layer mounted above the other layer. Each radiator assembly 16 includes four planar wings/radiators 18 mounted at right angles about the mast 12. Note that only three of the four radiators 18 of each assembly 16 are shown. Each radiator 18 is formed by a grid of rods 20 and supported by a spacer bar 22 which is shored to the supporting mast 12 at the top and bottom of the radiator assembly 16 by clamping hardware 23.

Each two opposing radiators 18 of a radiator assembly 16 form a pair. In a batwing assembly 16 there is an East-West ("E-W") pair of radiators and a North-South ("N-S") pair of radiators. Each pair of radiators is fed 90 degrees out of phase with respect to the other pair. As a result, the signal will be transmitted in a horizontal pattern that is essentially omni-directional.

It must be noted that an antenna 10, in accordance with the present invention, is not limited to the number of slots 14 or radiator assemblies 16 shown in FIG. 1. Various antenna gains can be achieved for both the VHF and UHF channels by changing the number of layers of radiator assemblies 16.

In a preferred embodiment of the present invention the VHF signal can be transmitted independent of the UHF signal. A branching feeding type system is utilized to deliver the VHF signal to each radiator 18. In an exemplary branching type feed system, two coaxial transmission lines 24, 26 are utilized to feed the VHF signal to the batwing assemblies 16. In an exemplary embodiment, the signal feeds into at least two junction boxes 28, 30 one for the N-S sets of radiators 18 and one for the E-W sets of radiators. Each junction box is fed by coaxial transmission line 24, 26 that may be followed by a wide band impedance matching transformer with the transmission line 24, 26. The impedance matching in the antenna 10 provides high quality TV pictures with a relatively flat voltage standing wave ratio (VSWR) across the total TV channel. Transformers are also utilized to provide adjustment for minimum VSWR at the picture carrier.

At an input 36 to the mast 12, a coaxial transmission line 38 which serves as an inner conductor to the mast 12 is provided for feeding a UHF signal to the antenna 10. The coaxial transmission line 38 includes an inner conductor 40. In an exemplary embodiment of an antenna 10, in accordance with the present invention, the inner conductor 40 is made from copper.

Figure 2:
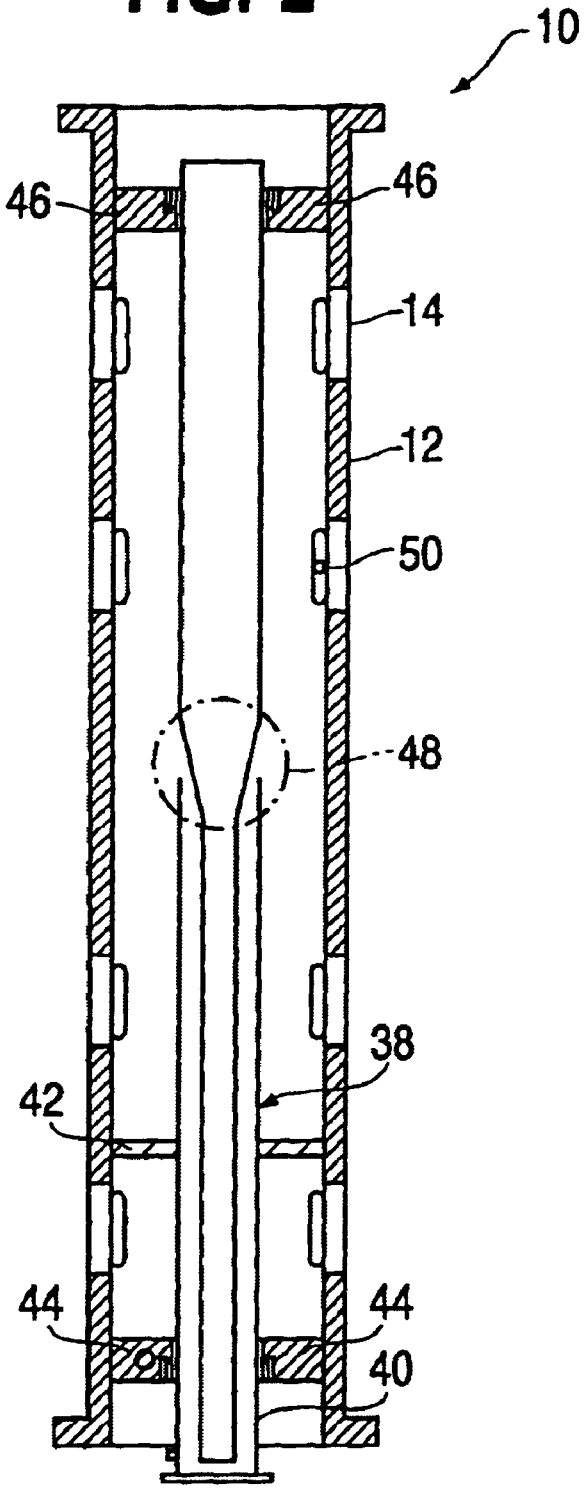
FIG. 2 is a side cut away view of the antenna of FIG. 1.

As illustrated in FIG. 2, the transmission line 38 is positioned concentrically by pin 42 and locked in place with, for example, a bottom clamping spoke short 44 at the base of the antenna. Centering pin 42 is a non-conductive, moveable/adjustable support that hold the inner conductor 38 centered within the outer conductor (i.e., the mast 12) without making an electrical connection between the inner conductor 38 and outer conductor 12. In an exemplary embodiment the pin is ceramic and Teflon capped.

A top spoke short 46 may also be placed at the top of the antenna. In an exemplary embodiment, in accordance with the present invention, the top spoke short 46 is a sliding spoke short placed at the top of the antenna that allows movement of the inner conductor 40 with respect to the outer conductor 12. When there are temperature changes, the inner conductor 40 moves with respect to the outer conductor 12 because of the difference between the coefficients of expansion for the copper inner conductor 40 and the steel or aluminum mast/outer conductor 12.

Also, the top sliding spoke short 46 allows for easy servicing of the inner conductor 40 or the feed point 48. The inner conductor 40 or the feed point 48 can be or extracted from the antenna without removal of the antenna from the tower.

In a preferred embodiment, in accordance with the present invention, as shown in FIG. 2, a center feed system is utilized to deliver the UHF signal to the slots 14. Each slot is provided with coupler 50 that is located on the inside of the mast 12 between the ends of each longitudinal slot 14.

During operation of the antenna, the UHF signal travels through the transmission line 38 up to the feed point 48 that is positioned at or near the center of the antenna 10 or substantially intermediate of the bottom spoke short 44 and top spoke short 46. The UHF signal at the center feed point 48 and splits in half, and a portion of the signal travels above the feed point 48, while a portion of the signal travels below the feed point 48.

The advantage of center feeding here is that the signal travels outward from the center in both directions. The resultant phase taper across the entire aperture of the antenna is therefore zero. In addition, the beam sway associated with frequency change is thus eliminated.

Moreover, the above slotted coaxial antenna design is not limited to an internally center fed harness design. However, the center fed design allows for illuminations (i.e., the relative radiated amplitude and phase from layer to layer in the elevation plane) to be chosen, such that the majority of energy emanates from the center portion of the slots in the antenna's aperture.

Choosing this type of illumination provides two significant advantages. First, it offers pattern stability in the elevation plane that is necessary for DTV operation. Second, it capitalizes on the feed system of the assemblies 16, which can be positioned such that the radiators 18, feed lines 24, 26, and any other VHF signal transmitting components are a distance from the high power part of the UHF aperture. This in turn minimizes the effect the VHF antenna has on the radiation patterns of the UHF antenna.

It is now apparent that the antenna system design of the present invention has a number of features and advantages over the prior art, particularly in respect to increased broadband bandwidth capabilities, minimal tower wind loading, no beam sway, and improved antenna output response performance suitable for simultaneous UHF and low- and mid-band VHF broadcasts, etc.

Figure 3:
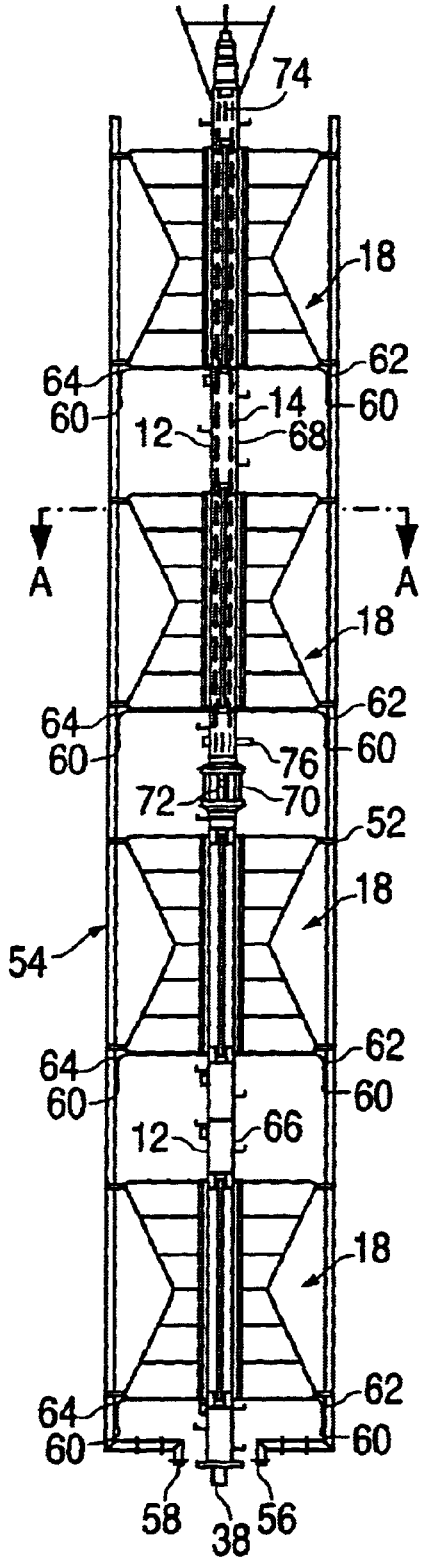
FIG. 3 is a side plan view of a common aperture UHF/horizontally polarized low- and mid-band VHF antenna in accordance with a preferred embodiment of the present invention.

FIG. 3 is a side plan view of a common aperture UHF/Horizontally polarized low- and mid-band VHF antenna in accordance with an exemplary embodiment of the present invention. As shown in FIG. 3, the antenna 10 includes VHF feed lines 52,54. One of the VHF feed lines is utilized to feed the N-S pairs of radiators and the other is utilized to feed the E-W pairs of radiators. Inputs 56, 58 are the inputs to the feed lines 52, 54 respectively.

Tap off points 60 are located at each layer of each of the feed lines 52, 54. In an exemplary embodiment, there are two tap off points 60 at each layer. There are two secondary feed lines 62, 64. At each layer, one tap off point 60 is utilized to connect one of the two secondary feed lines 62, 64 to the N-S pair of batwing radiators, while the other tap off point 60 is utilized to connect the other of the two secondary feed lines 62, 64 to the E-W pair of radiators. The tap off points 60 feed the signal to each radiator 18.

VHF mast 66 supports the UHF mast/outer conductor 68 and together the VHF mast 66 and the UHF mast form a support mast 12 for the VHF radiators 18. A support mast adapter section 70 allows for the coupling between the VHF mast 66 and the UHF outer conductor/mast 68. The support mast adapter section 70 connects the UHF coaxial feed line 38 that runs through the VHF mast 66 to the input 72 of the UHF mast 68. The UHF feed line 38 extends the input signal to the UHF mast 68 to the tower top. Also, the location 74 of the top short 46 and the location 76 of the bottom short are shown in FIG. 3.

Figure 4:
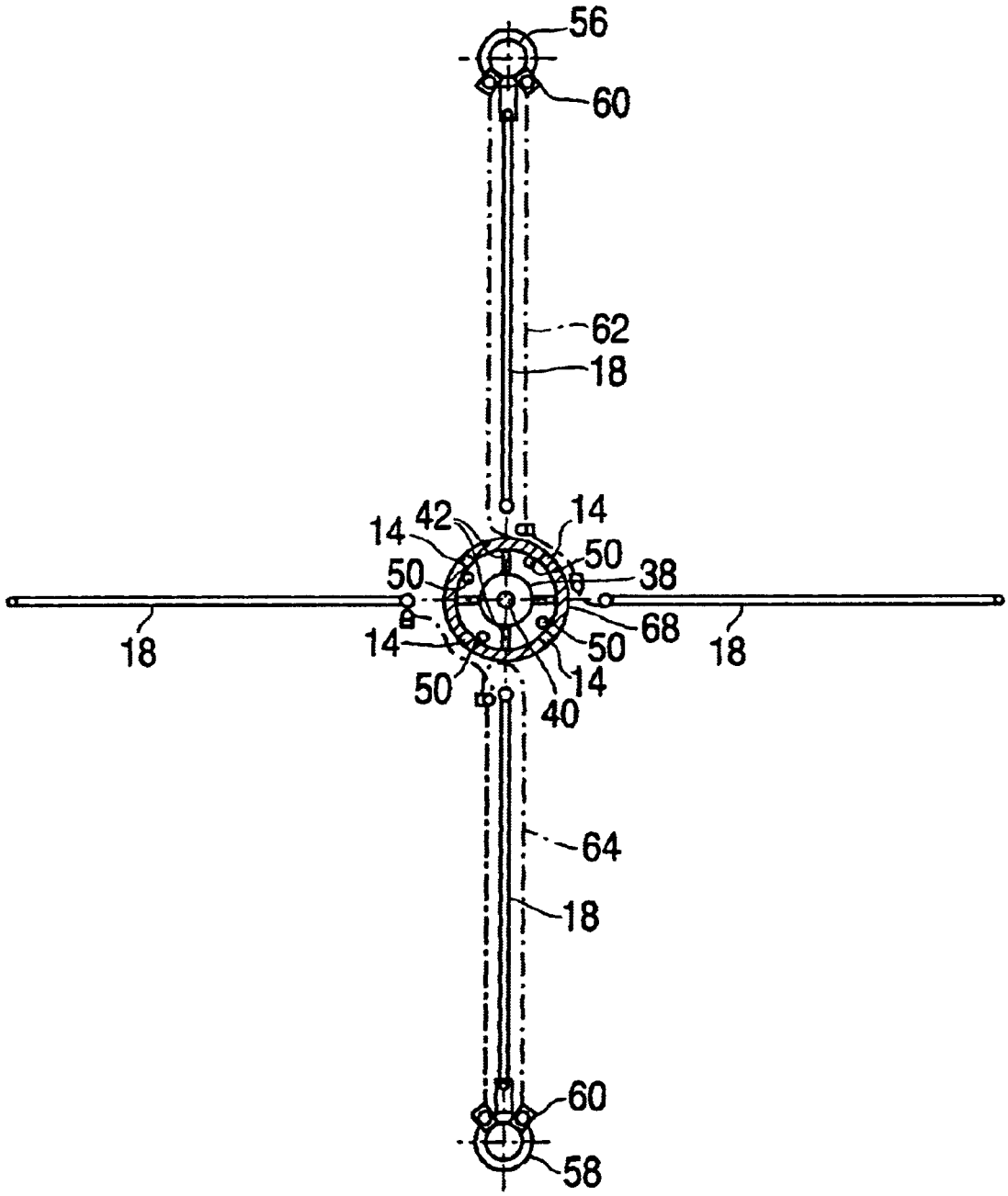
FIG. 4 is a cross-section of the antenna of FIG. 3 along the A—A axis.

FIG. 4 is a cross-section of the antenna of FIG. 3 along the A—A axis. Shown in FIG. 4 are radiators 18, the coaxial feed lines 56 and 58 that feed one or the other of the N-S and E-W pairs of radiators. Also, shown are the tap off points 60 to which the secondary feed lines 62 and 64 are connected. The radiators 18 surround the mast 68. The transmission line 38, which is the UHF coaxial inner conductor and UHF feed outer conductor, incorporates the inner conductor 40 that serves are the UHF feed inner conductor. Centering pin 42 holds the transmission line 38 centered within the UHF mast 68. Also shown in FIG. 4 are the UHF slots 14 and the couplers 50 that are located within the slots 14.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An antenna for simultaneous UHF and VHF broadcast, comprising:

a slotted UHF coaxial antenna having an inner conductor and an outer conductor;

a VHF batwing radiator assembly mounted to the outer conductor of the coaxial antenna; and a feed line for feeding the batwing radiator assembly separately from the coaxial antenna.

2. The antenna of claim 1, wherein the batwing radiator assembly comprises four planar wings.

3. The antenna of claim 2, wherein the planar wings are spaced concentrically around the outer conductor.

4. The antenna of claim 1, wherein the inner conductor comprises a transmission line inner conductor and a transmission line outer conductor.

5. The antenna of claim 4, wherein the transmission line inner conductor is made from copper.

6. The antenna of claim 1, wherein the outer conductor is made from steel.

7. The antenna of claim 1, wherein the inner conductor is connected to a center feed.

8. The antenna of claim 7, wherein the center feed is substantially intermediate a top spoke short and bottom spoke short.

9. An antenna for simultaneous UHF and VHF broadcast, comprising:

slot means for transmitting a UHF signal;

wire means mounted to the UHF signal transmitting slot means for transmitting a VHF signal; and feed means for feeding the UHF signal transmitting slot means separate from the VHF signal transmitting wire means.

10. The antenna of claim 9, wherein the VHF signal transmitting wire means comprises a batwing radiator assembly.

11. The antenna of claim 10, wherein said feed means includes a branch feed means to feed the batwing radiator assembly.

12. The antenna of claim 9, wherein the UHF signal transmitting slot means includes an inner conductor for feeding the UHF signal transmitting slot means.

13. The antenna of claim 12, wherein the inner conductor includes a transmission line inner conductor and a transmission line outer conductor.

14. A method of constructing a UHF and VHF broadcast antenna, comprising:

forming a UHF slotted coaxial antenna having an inner and an outer conductor;

mounting a VHF batwing radiator assembly to the outer conductor of the coaxial antenna; and connecting a feed line to the batwing radiator assembly.

15. The method of claim 14, wherein the mounting of the batwing radiator assembly to the outer conductor comprises spacing four planar wings concentrically around the outer conductor.

16. The method of claim 15, further comprising feeding a VHF signal to each of the four planar wings separately.

17. The method of claim 15, wherein the forming of the coaxial antenna comprises constructing said inner conductor to have a transmission inner conductor and a transmission outer conductor.

18. The method of claim 17, wherein the constructing of the inner conductor further comprises providing a feed point substantially intermediate of a top spoke short and a bottom spoke short of the coaxial antenna.

19. The method of claim 17, wherein the transmission inner conductor is made from copper.

* * * * *